United States Patent [19]

Ciganko

[11] 4,372,238

[45] Feb. 8, 1983

[54] TOY STITCHING SET

[75] Inventor: David J. Ciganko, East Aurora, N.Y.

[73] Assignee: The Quaker Oats Company, Chicago, Ill.

[21] Appl. No.: 224,275

[22] Filed: Jan. 12, 1981

[51] Int. Cl.[3] ..... D05C 17/00; B03B 29/00

[52] U.S. Cl. ..... 112/439; 28/151

[58] Field of Search ..... 112/439, 440, 410, 411, 112/266.2; 28/151, 152

[56] References Cited

U.S. PATENT DOCUMENTS 1,331,927 2/1920 Johnson ..... 28/151

1,667,330 4/1928 Odlin ..... 28/151

4,044,437 8/1977 Ebenstein ..... 28/151

FOREIGN PATENT DOCUMENTS 522149 6/1940 United Kingdom .

*Primary Examiner*—Doris L. Troutman

*Attorney, Agent, or Firm*—Cumpston & Shaw

[57] ABSTRACT

A stitching grid is formed from a rigid lattice plate having spaced perforations extending therethrough surrounded by lands. A design of one or more colors is imprinted on the lands. Colored yarn is stitched through the perforations with the color of the yarn matching the color on the lands to produce a yarn embroidered design on the grid.

6 Claims, 3 Drawing Figures

TOY STITCHING SET

BACKGROUND OF THE INVENTION

1. Field of the Invention

The present invention relates generally to stitching, and more particularly to a rigid stitching grid having perforations surrounded by lands, a colored design imprinted on the lands, and colored yarn stitched through the perforations with the color of the yarn matching the color of the lands to form a rigid yarn embroidered design.

2. Description of the Prior Art

Stitching sets are known comprising a flexible cloth grid having a yarn latticework defining perforations. A colored design is imprinted on the yarn latticework. Colored yarn is provided which is stitched through the perforations with the color of the yarn matching the color of the design to form a flexible yarn embroidered design.

SUMMARY OF THE INVENTION

It is a primary object of the present invention to provide a stitching grid formed from a rigid lattice plate having spaced perforations extending therethrough surrounded by lands. A design of one or more colors is imprinted on the lands. Colored yarn is stitched through the perforations with the color of the yarn matching the color on the lands to produce a yarn embroidered design on the grid.

In another aspect of the invention, the width of each land between adjacent perforations is approximately 0.7 times the width of each perforation. In a preferred embodiment, the width of each land is approximately 0.25 cm.

One advantage of the present invention is to provide a rigid stitching grid that will not buckle or fold over upon itself if a child catches a loop of yarn over a corner of the grid and pulls the yarn tight.

Another advantage of the invention is to provide solid land material of large area surrounding each perforation. This facilitates accurate placement of the colored design on the lands to clearly indicate to the child the color of yarn that should be threaded through each perforation. Such accurate placement of the colors on the lands surrounding a perforation is particularly important where as many as four different colored yarns are to be threaded through a single perforation. By providing a large land area, the different colored land areas surrounding a perforation are clearly visible and particularly easy for a child to see.

By using a large colored area, it is also possible to use colors on the lands that exactly match the colors of the yarn. Narrow land areas may require the use of an objectionable, overly intense color to achieve the effect of a wider land of exact yarn color, and to enable the child to see it. Matching colors of the land and yarn overcomes the problems inherent in a narrow land, and facilitates filling in of grid spaces where no particular pattern of stitching is required. If a child, for example, misses a land space, or the yarn gets drawn too tight, the exposure of some of the background land area will not be objectionably noticeable since the land color exactly matches the yarn color.

The invention and its advantages will become more apparent from the detailed description of the invention presented below.

BRIEF DESCRIPTION OF THE DRAWING

The details of this invention will be described in connection with the accompanying drawing, in which.

DETAILED DESCRIPTION OF THE INVENTION

Figure 1:
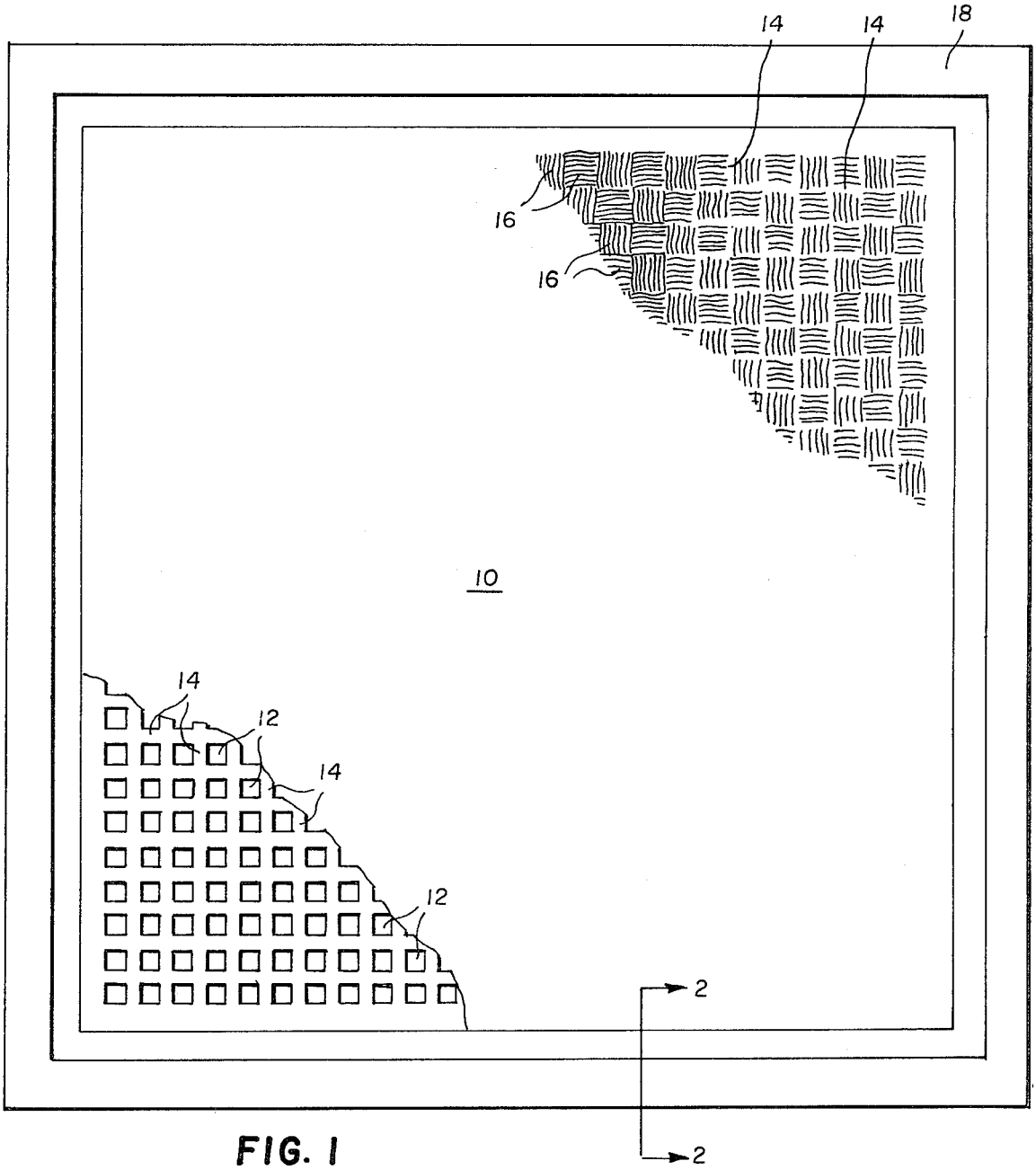
FIG. 1 is a top plan view of a toy stitching set in accordance with this invention in which one segment thereof shows the colored design, and another segment thereof shows the design embroidered with colored yarn.
Figure 2:
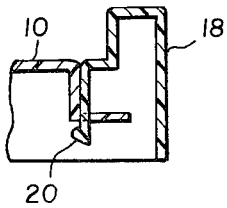
FIG. 2 is a segmental section view taken substantially along lines 2—2 of FIG. 1.
Figure 3:
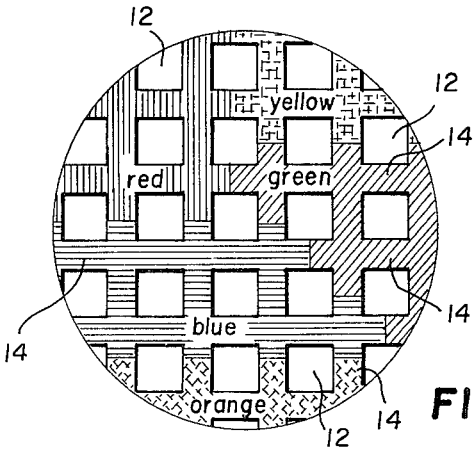
FIG. 3 is an enlarged segmental view of a portion of the stitching grid.

Referring to FIGS. 1 and 3 of the drawing, a toy stitching set is disclosed comprising a stitching lattice grid or plate 10. The stitching grid is formed from any suitable rigid material, such as plastic, and has spaced perforations 12 extending therethrough surrounded by lands 14. Any suitable design of one or more colors is printed or painted on the lands. Colored yarn 16 matching the colors on lands 14 may be stitched by any suitable stitch such as a fill-in stitch, needlepoint or cross-stitch, for example, through the perforations and over the lands. When the design is completely embroidered by colored yarn 16, grid 10 may be manually snapped into a plastic frame 18 within which it is releasably held by spaced flexible fingers 20 surrounding the grid, only one of which is shown in FIG. 2.

An advantage of providing a rigid stitching grid is that children can more conveniently handle or use the grid without the grid buckling or folding. For example, if a child catches a loop of yarn over a corner of the grid and pulls tight, while stitching, the grid will not buckle and fold as would a soft flexible grid. The grid remains flat, and the child will notice that the yarn is caught, and can easily remedy the problem. Also, a rigid grid 10 facilitates application of a colored design to the grid.

Another advantage of using a rigid stitching grid is that it is possible to provide lands 14 of large width relative to the width of the peforations 12 as best seen in FIG. 3. As a consequence, a greater land area is provided onto which the design can be printed or painted. This has the added advantages of providing a colored design that can be easily seen by a child, and one that can be accurately positioned on the lands surrounding a perforation. This is particularly important where the colors indicate to a child the color of the yarn that should be threaded through each perforation.

A greater land area further allows accurate matching of the yarn color with the land color. An advantage of such color matching is to minimize any color contrast if a child misses a space, or the yarn is drawn too tightly exposing some of the design background. Such color matching may not be achieved if the land area is narrow, since overly intense colors for the land area relative to the yarn colors may be needed to give the effect to the child of a wider land.

In a preferred embodiment of the invention, a land width that has worked satisfactorily is one that measures approximately 0.7 times the width of the perforation, or approximately 0.25 centimeters. These dimensions are, of course, exemplary only.

Although the perforations 12 are substantially square, they, of course, can assume any other suitable shape, such as circular or triangular, for example.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy stitching set comprising:

a rigid lattice plate having spaced perforations extending therethrough surrounded by lands to form a stitching grid wherein the width of each land between a pair of adjacent perforations is approximately 0.7 times the width of each perforation; and a design of one or more colors imprinted on said lands whereby yarn matching the colors may be stitched to said grid to embroider said design.

2. A toy stitching set according to claim 1 wherein the width of such land is approximately 0.25 cm.

3. The toy stitching set of claim 1 further comprising:

colored yarn stitched through said perforations with the color of said yarn matching the colors on said lands to produce a yarn embroidered design on said grid.

4. A toy stitching set according to claim 3 wherein the width of each land between a pair of adjacent perforations is approximately 0.7 times the width of each perforation.

5. A toy stitching set according to claim 3 wherein the width of each land is approximately 0.25 cm.

6. A toy stitchery set according to claim 1 and including a frame for releasably supporting said lattice plate.

* * * * *